US006295687B1

(12) United States Patent
Dehart

(10) Patent No.: US 6,295,687 B1
(45) Date of Patent: Oct. 2, 2001

(54) BUFF SECTION ASSEMBLY AND METHOD OF MAKING

(76) Inventor: Michael Glenn Dehart, 745 Boundary St., Apartment 210, Newton, NC (US) 28658

( * ) Notice: Subject to any disclaimer, the term of this patent is extended or adjusted under 35 U.S.C. 154(b) by 0 days.

(21) Appl. No.: 09/375,577

(22) Filed: Aug. 17, 1999

(51) Int. Cl.[7] ..... A46B 3/10; A46B 7/10; A46D 3/00

(52) U.S. Cl. ..... 15/181; 15/230; 15/230.1; 15/230.14; 15/230.17; 15/230.19; 451/465; 300/21

(58) Field of Search ..... 15/179, 181, 198, 15/230, 230.1, 230.14, 230.16, 230.17, 230.19; 451/464–466, 469; 300/21

(56) References Cited

U.S. PATENT DOCUMENTS

| | | | | |
|---|---|---|---|---|
| 445,005 | * | 1/1891 | Mahler | 15/181 |
| 1,470,740 | * | 10/1923 | Hose | 15/230.14 |
| 2,160,029 | | 5/1939 | Nielsen | 15/179 |
| 2,244,582 | * | 6/1941 | Thompson | 15/230.1 |
| 2,290,575 | * | 7/1942 | Potter | 15/181 |
| 2,534,892 | * | 12/1950 | Wilhide | 15/181 |
| 2,687,602 | | 8/1954 | Churchill | 15/230.14 |
| 2,724,937 | | 11/1955 | Churchill | 15/230.13 |
| 2,757,401 | | 8/1956 | Peterson | 15/182 |
| 3,212,819 | * | 10/1965 | Churchill | 15/181 X |
| 3,365,742 | | 1/1968 | Schaffner | 15/230 |
| 3,407,425 | | 10/1968 | Drumm | 15/181 |
| 3,438,080 | | 4/1969 | Atkins | 15/230.13 |
| 4,504,999 | | 3/1985 | Pedrotte | 15/230.1 |
| 4,850,158 | | 7/1989 | Schaffner | 451/466 |
| 5,560,744 | | 10/1996 | Schaffner, III | 451/490 |

FOREIGN PATENT DOCUMENTS

| | | | | |
|---|---|---|---|---|
| 157225 | * | 6/1954 | (AU) | 15/230.17 |
| 237804 | * | 7/1969 | (SU) | 15/181 |

OTHER PUBLICATIONS

Panduit Pan–Steel™ Stainless Steel Ties undated admitted prior art.

* cited by examiner

*Primary Examiner*—Mark Spisich
(74) *Attorney, Agent, or Firm*—Renner, Otto, Boiselle & Sklar, LLP

(57) ABSTRACT

An assembly of buff or brush wheels with or without spacers is stacked, compressed, and held together as an integrated unit to form an assembly of such wheels having a specified face width which then may be mounted as a unit on a machine arbor or drive shaft. The assembly is held together in such a manner that the ganged stack is yieldable and may be further compressed when assembled on the machine arbor. The assembly may also be slightly expanded to obtain a better fit on the machine. The wheel assembly in one form is held at the desired face width by adjustable ties extending through paired holes in core plates in the wheels. In another embodiment carriage bolts extending through the core plates form adjustable screw clamps.

18 Claims, 6 Drawing Sheets

BUFF SECTION ASSEMBLY AND METHOD OF MAKING

DISCLOSURE

This invention relates generally to a rotary wheel type buff or brush section assembly, and more particularly to the assembly of such sections into sub-assemblies or ganged sections for assembly on the arbors or drive shafts of wide face buffing or brushing machines.

BACKGROUND OF THE INVENTION

Buffing or brushing machines often utilize relatively long power driven arbors or shafts on which buff sections or wheels are mounted for rotation with the arbor or shaft. Spacers are sometimes interposed between the wheels. Spacers may be simple rings or worn buffing or brush wheels.

Buffing wheels may have a wide range of materials and can be used for aggressive material removal or just polishing and coloring. The materials may range from soft to coarse cloth, or abrasive fabric, or sand paper or sheets. The same is true of brush wheels and the materials used for the brush filaments.

In forming a buffing wheel, a clinch ring is sometimes employed which includes teeth which bite into the folded radially extending fabric, cloth, or paper at the fold. When the buff wheel is formed a core plate or hub is normally press-fit into clinch ring. The core plate normally includes a center hole or openings which fit on the drive arbor of the machine. A central opening may include notches or keyways designed to fit drive keys on the arbor. Brush wheels may be made in generally similar fashion but normally include an annular wire core in the clinch ring around which the radially extending filaments are folded. Examples of buff wheels made with clinch rings are seen in Atkins U.S. Pat. No. 3,438,080, or Pedrotte U.S. Pat. No. 4,504,999. Examples of wheel type brushes with such rings may be seen in U.S. Pat. No. 2,160,829 to Nielsen, and U.S. Pat. No. 2,757,401 to Peterson.

Some buff wheels have the fabric or buffing or abrading material attached directly to the hub or core plate and do not use a separate clinch ring or channel. These types of wheels are shown for example in Churchill U.S. Pat. Nos. 2,724,937 and 2,687,602, and are sold under the well known trademark CHURCHILL by the JacksonLea unit of Jason Incorporated at Conover, N.C.

Prior efforts to form ganged sub-assemblies of buff wheels with or without spacers are shown in Schaffner U.S. Pat. Nos. 3,365,742 and 5,650,744. Both utilize straps or tabs which extend axially inside the clinch rings connecting buff sections under pressure. The straps or tabs are welded in place and a rigid or unyielding sub-assembly is formed. Since the sub-assemblies will not yield axially or further compress, the machine operator is limited to an arbitrary unyieldable axial dimension increment which when assembled on the shaft may not precisely fit the total axial length of the shaft. Nothing is more frustrating than to try to make something fit that will not fit. Without the proper fit one of the assemblies has to be removed and replaced by individual wheel segments or spacers. This of course adds to the machine downtime, cost, and requires more labor, and unnecessary wheel inventory. It would accordingly be desirable if the stack or sub-assembly of wheels would yield axially so that proper fit could be obtained simply by further compression or expansion. This of course is impossible with a rigid sub-assembly.

SUMMARY OF THE INVENTION

A unitized assembly of buffing or brushing wheel sections with or without spacers between individual wheel sections is compressed under pressure and held together by cable ties in one embodiment, or screw clamps in another embodiment. The purpose of building the assembly is to aid the customer during the loading and unloading of the machine shaft. Buff sections are generally made on a metal clinch ring with radially projecting fabric, paper, abrasive sheets, or a non-woven material serving as the buffing surface. The buff sections have a permanent metal hub, core plate or disc placed in the center of the ring, specifically sized for the customer's machine shaft. The spacers may or may not have a metal center core plate or disc, and may be made of various materials such as soft wood or even rubber or plastic. The buffs and or spacers are stacked on a press such as an hydraulic press and the arbor holes in the center plates are lined up or aligned so that the buff assembly will slide easily onto the customer's shaft. The buffs and or spacers are compressed to a certain degree and then held together in one embodiment of the invention by cable ties that have been threaded through special holes in the metal center core plates or discs. The cable ties are then tightened with a pneumatic tool to hold the assembly together at a customer-specified face width.

In another embodiment, screw clamps are tightened to maintain the specified face width. These design embodiments are an improvement over rigid buff assemblies since the customer now has the option to compress the unit even further once placed onto the machine shaft, or in some cases even to enlarge the face width by loosening the cable ties or screw clamps.

In the cable tie embodiments of the invention the core plates or discs are provided with paired hole or hole sets in the outer periphery of the core plates. The holes of each pair have parallel symmetrical edges facing each other which are also parallel to and equally spaced from a diameter of the wheel. There may be a number of sets of such holes, each set having the opposed parallel symmetrical edges. The assembly however, needs to be balanced. The cable tie may be in the form of a stainless steel band having a transversely slotted end threaded through the helix of a screw mounted on the other end. The screw is positioned about midway between the slot edges at an end face of the assembly. The free slotted end is threaded through the helix after the stacked wheels or wheels and spacers are aligned, stacked, and compressed. The tie may be tightened simply by turning the screw with a pneumatic tool. The stack is then an integrated unit under compression which can be compressed further or slightly expanded for axial fit on the arbor or shaft of the machine.

In the other embodiment, the stack is held in a preferred state of compression to obtain the desired face width by nuts threaded on carriage bolts extending through the core plates. The assembly may be further compressed or slightly enlarged simply by tightening or loosening the nuts. The assembly is thus field adjustable in axial length or as to face width for ease of machine assembly.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
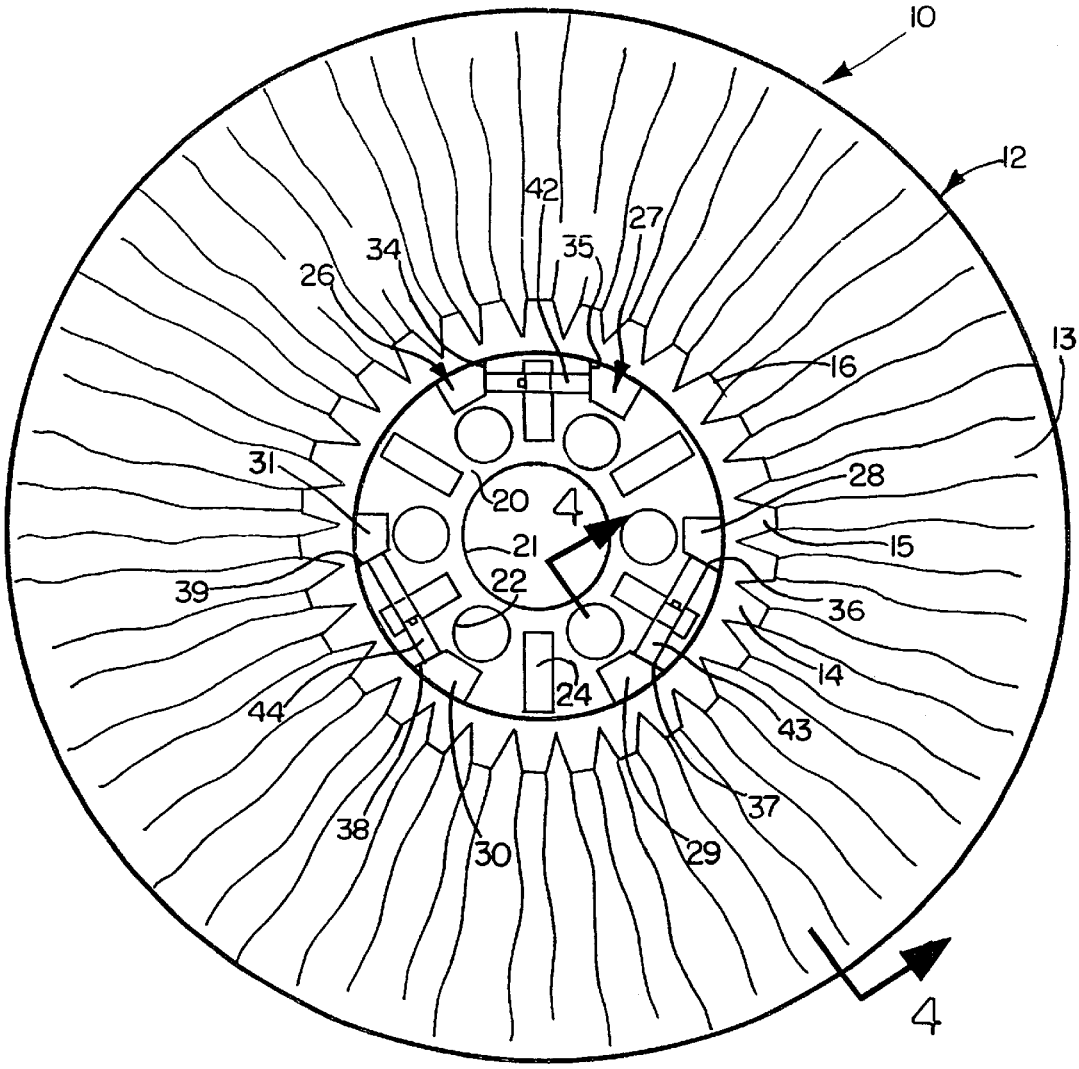
FIG. 1 is an axial end elevation of one form of a buffing wheel assembly in accordance with the invention.
Figure 4:
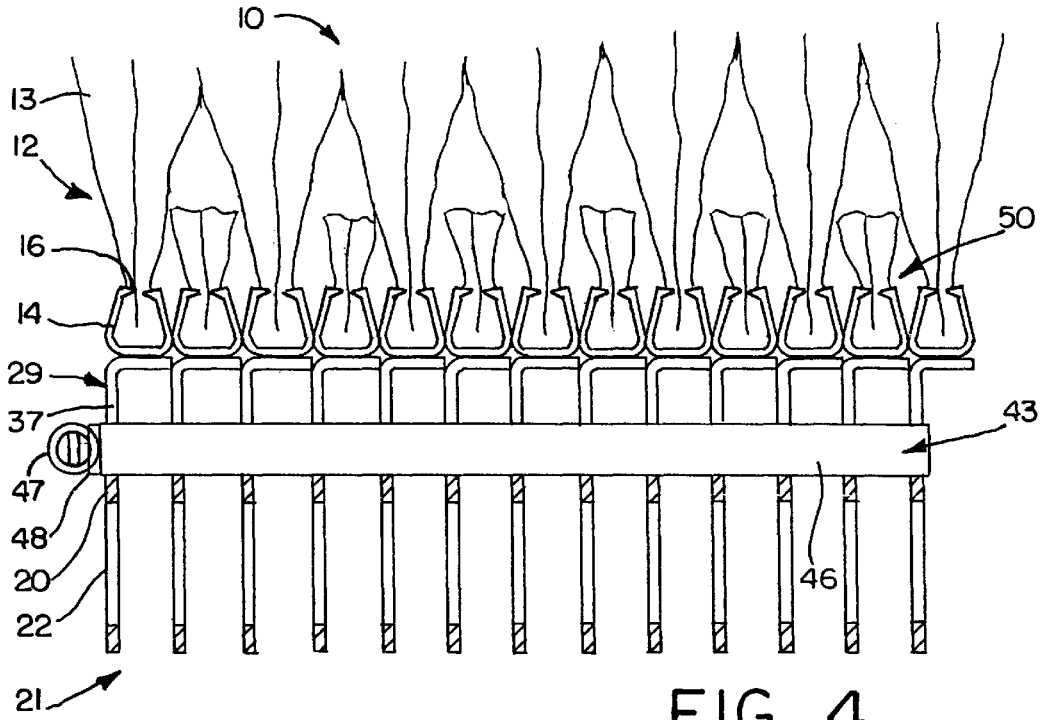
FIG. 4 is a fragmentary quarter section taken substantially on the line 4—4 of FIG. 1.

Referring initially to FIGS. 1 and 4 there is illustrated a buff or brush assembly in accordance with the present invention shown generally at 10. It will be appreciated that the buff assembly comprises a series of stacked wheels with or without spacers, and since FIG. 1 is an axially end view of the assembly, only the end wheel is shown generally at 12. The buffing wheel comprises radially extending fabric or other buffing material 13 which is folded and held by clinch ring 14 which has teeth 15 formed in the edges thereof with the pointed teeth being driven into the fabric as indicated by the flattened tips 16. The individual wheels are formed on a press into the U-shaped configuration shown generally in FIG. 4 with the fabric material being folded or pleated and puckering outwardly from the more narrow portion at the teeth tips 16.

While FIGS. 1 and 4 illustrate a puckered fabric buffing wheel, it will be appreciated that the actual buffing or brushing material may vary widely such as a buffing wheel formed of layers of leather, sisal, sandpaper, emery cloth, or abrasive coated paper or cloth and also formed from combinations of the above materials.

If the radially projecting material is brush filaments, they too may be formed from a variety of materials ranging from very soft organic or plastic filaments to harder metal filaments such as wire or abrasive entrained in plastic.

Referring again to FIGS. 1 and 4 it will be seen that each clinch ring of each wheel has a core plate shown generally at 20 secured in the center thereof. The core plate may be press fit and/or welded in place in the clinch ring. The core plate 20 may be provided with a central hole 21 accommodating the arbor of the machine as well as intermediate holes at 22 which are six in number and equally circumferentially spaced. The core plate may also have radially extending indentations seen at 24 which stiffen the plate.

In addition to the holes and reinforcing indentations as noted above, the core plate is provided with three equally circumferentially spaced sets of holes at the periphery thereof. One hole set is shown at 26 and 27. A second hole set is shown at 28 and 29. A third set is seen at 30 and 31. The edges of the holes of the set which face each other are parallel and symmetrical about a diameter of the wheel. Such edges of the holes 26 and 27 are shown at 34 and 35, respectively. The edges of the holes 28 and 29 are shown at 36 and 37, respectively. Similarly, the parallel and symmetrical edges for the holes 30 and 31 are shown at 38, and 39, respectively. The hole sets in each core plate are aligned and each has the parallel interior symmetrical edge. The hole sets in the FIG. 1 embodiment are three in number and they accommodate the three ties illustrated at 42, 43, and 44.

Although various forms of ties may be employed, one illustrated form of tie is in the form of a stainless steel band 46 which has a helix or screw 47 mounted on one end as seen more clearly in FIG. 4. The opposite end 48 is provided with transverse slots and threaded between the screw or helix and the one end. The screw 47 may be rotated by a screw driver or in the preferred embodiment by a pneumatic tool. Care is taken to position the screw on the end of the assembly 10 with the screw drive recess extending parallel to the plane of the end core plate and positioned approximately halfway between the openings through which and around which the tie is threaded.

FIG. 4 thus illustrates the assembly in accordance with the present invention. The assembly is formed of seven regular buffing wheels with one regular buffing wheel at each end. Interposed between each buffing wheel is a spacer shown generally at 50. There are accordingly six spacers. The spacers illustrated may be in the form of worn and trimmed buffing wheels. Each has a core plate and the core plate is formed with the hole pattern seen in FIG. 1.

The assembly seen in FIG. 4 may be formed by stacking the various wheels and spacers in a manner so that the various holes are aligned. The stack is then subjected to a compression force as in a hydraulic press until the axially length of the working face of the assembly achieves a certain specification. With the stack held in such compressed condition, the tie 43 is threaded through the parallel holes and tightened as shown, preferably with a pneumatic tool.

The unitized assembly is then removed from the press and is shipped to a customer for assembly on the machine arbor or drive shaft. In the event the assembly 10 does not fit the substantially longer arbor or drive shaft, the installer may change the axially dimension of the assembly simply by compressing it further. Normally the assembly may be compressed by an external force and the band simply retightened to take up any looseness or slack. If for some reason the assembly needs to be expanded, the ties may be loosened to permit the wheels with or without spacers axially to expand.

Figure 2:
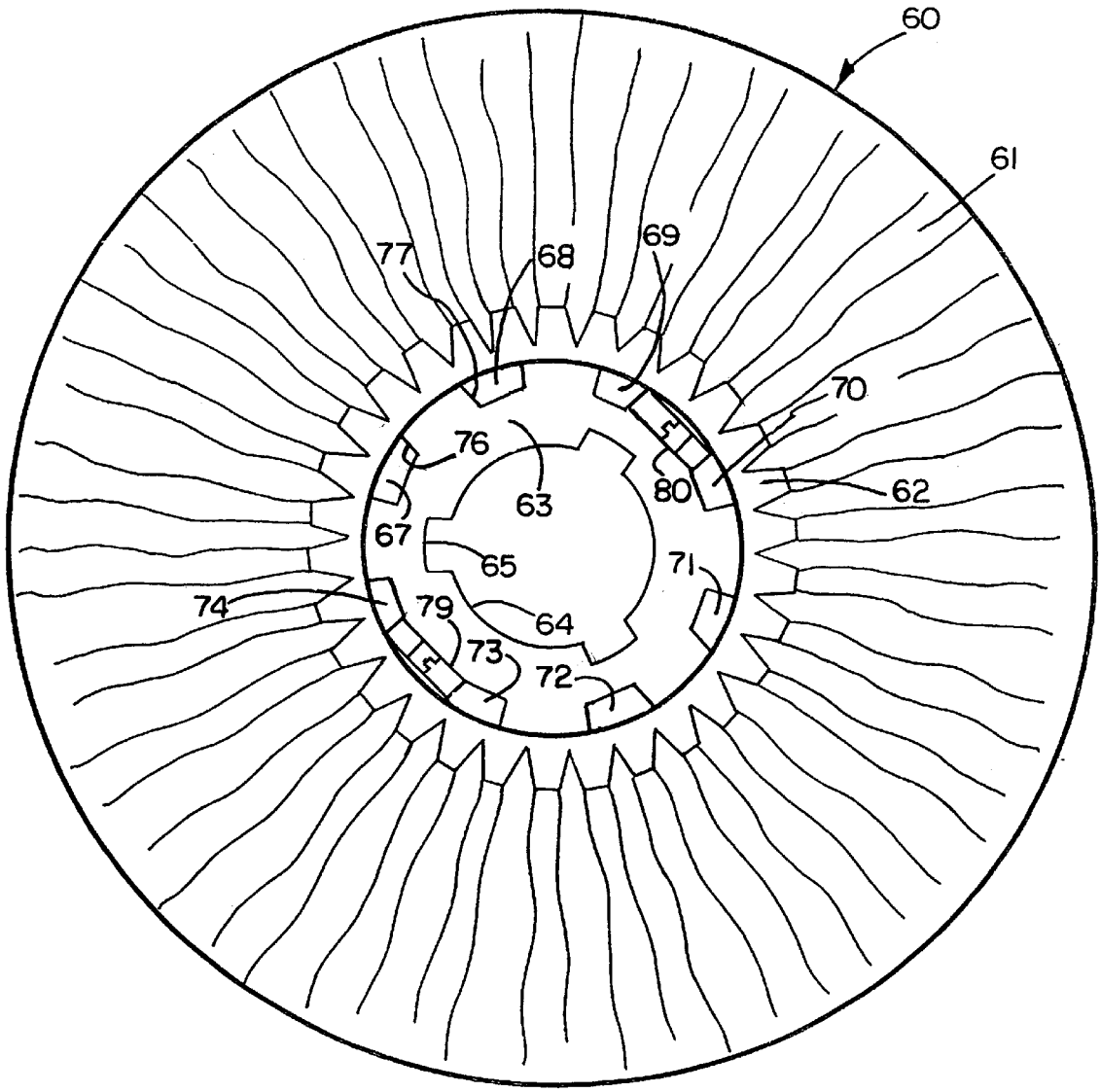
FIG. 2 is an axial end elevation of a somewhat modified form of the invention.

Referring now to FIG. 2, there is illustrated a somewhat modified form of ganged buffing wheel assembly. The assembly shown generally at 60 includes the radially extending buffing material 61 which is clinched at the fold by clinch ring 62. The core plate 63 is provided with a central hole 64 accommodating the arbor or drive shaft, and the hole may include equally spaced notches 65 which may interfit with drive lugs or keys on the drive shaft.

The periphery of the core plate is provided with four hole sets equally circumferentially spaced. One hole set is shown at 67 and 68. Another hole set is seen at 69 and 70. The third hole set is seen at 71 and 72, and the fourth hole set is seen at 73 and 74. The inner or facing edges of the holes of each set are parallel and symmetrical about a diameter of the wheel. These edges are seen at 76 and 77 for the holes 67 and 68, respectively. Each hole set has such parallel edges, and each hole set will accommodate a tie.

However, in the embodiment of FIG. 2, a tie is provided only at diametrically opposite hole sets as seen by the ties 79 and 80. Thus, although the assembly will accommodate four ties, only two are employed. The number of ties actually used may depend upon the size of the assembly being formed which may be determined by the customer specified face widths. The ties 79 and 80 may be of the same type as seen FIGS. 1 and 4 and such ties may be further tightened when the assembly is subsequently compressed or loosened axially to expand the assembly. Although other hole arrangements may by employed it is important that the wheel assembly be balanced. The assembly seen in FIG. 2 is made in the same way as the assembly seen in FIGS. 1 and 4.

Figure 3:
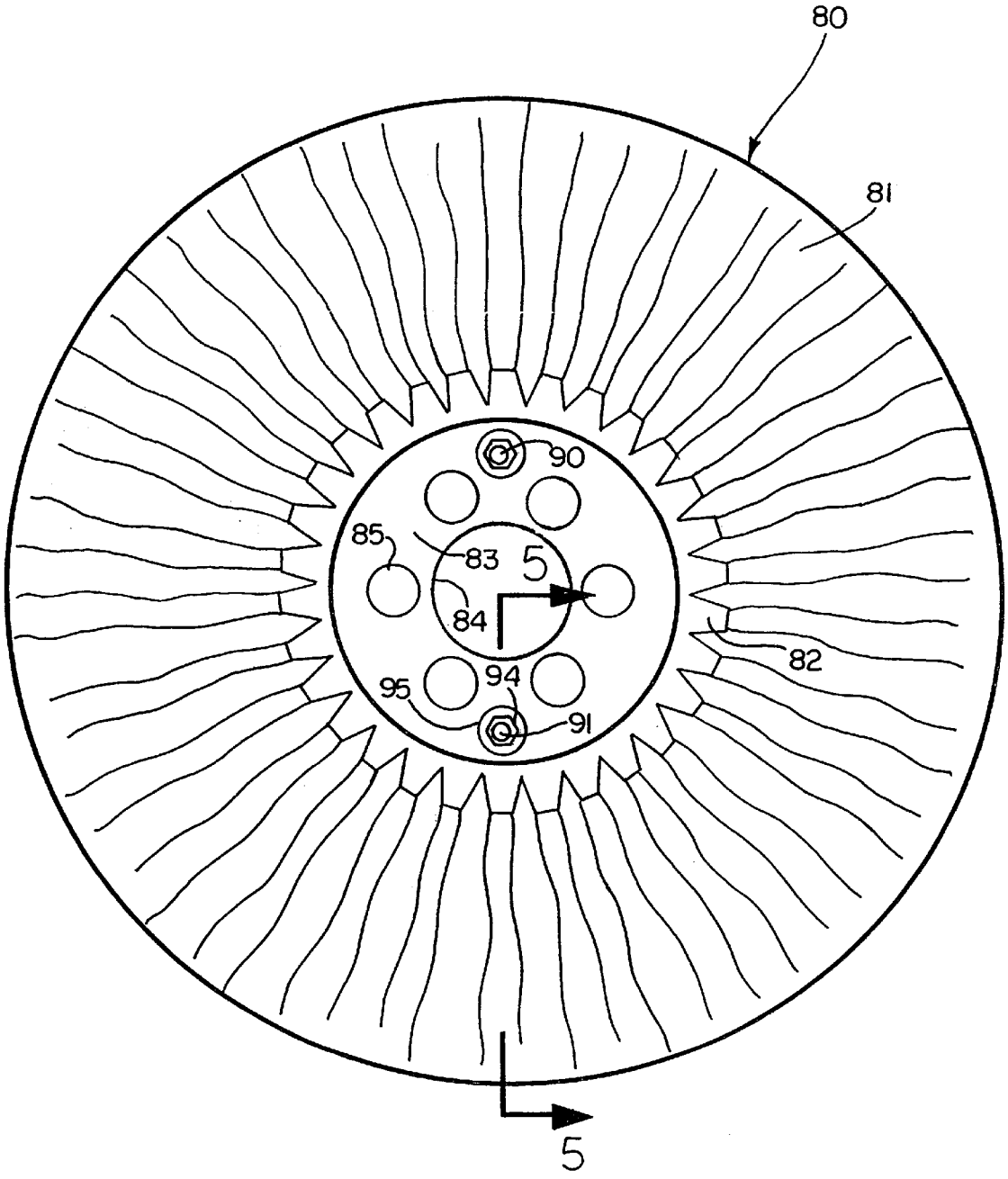
FIG. 3 is an axial end elevation of a further form of the invention.
Figure 5:
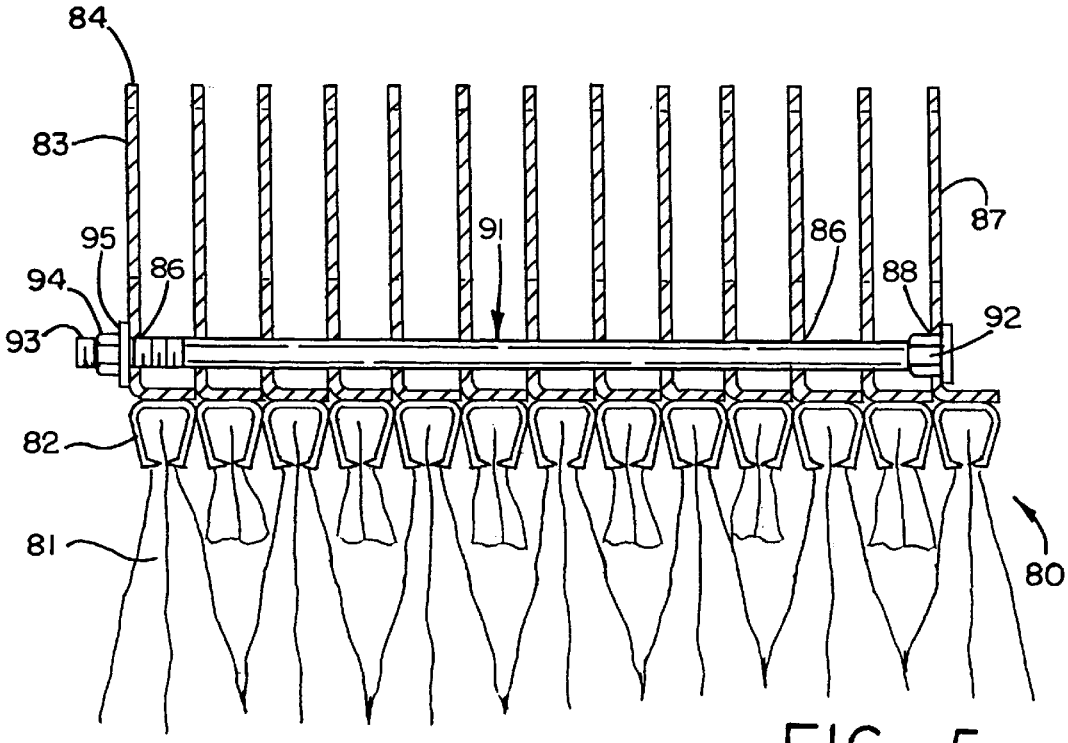
FIG. 5 is a fragmentary quarter section taken substantially on the line 5—5 of FIG. 3.

In the embodiments using the tie, it is important that the peripheral holes or opening sets be deep enough so that the ties may be easily threaded through the openings and clear the insides of the clinch rings. Referring now to FIGS. 3 and 5 there is illustrated a slightly modified form of wheel assembly. The wheel assembly shown generally at 80 includes the radially extending folded, pleated and puckered buffing material 81 which is held at the fold by clinch ring 82. The core plate 83 in each wheel assembly is shown at 83 and has a central hole 84, and intermediate holes 85 equally circumferentially spaced. Instead of peripheral holes or opening sets, each core plate is provided with diametrically opposite holes 86 with the exception of the core plate 87 on the opposite end as seen in FIG. 5. This core plate is provided with diametrically opposed hexagonal holes seen at 88. Such holes accommodate carriage bolts shown generally at 90 and 91. Each carriage bolt has a hexagonal head 92 which fits in the hole 88. The shaft of the carriage bolt extends through the other holes 86 and the end of the carriage bolt is threaded as indicated at 93. The threaded end of each carriage bolt accommodates a nut 94 and a washer 95.

The assembly 80 of FIGS. 3 and 5 may be made in the same manner as the assembly shown in FIG. 4. The assembly shown in FIG. 5 has the same number of full buff wheels and the same number of spacers as seen in FIG. 4. These stacked buffing wheels each with a core plate with the diametrically opposite holes are aligned and stacked on an hydraulic press, for example. When pressure is applied and the desired or specified face width is achieved, the carriage bolts are inserted and the nuts and washers are positioned on the threaded end and tightened to achieve the partially compressed unitized buff wheel assembly. The exposed threads on the end of the carriage bolts may be slightly distorted so that the nuts will not come off. When the assembly is positioned on the arbor or drive shaft of the machine, the assembly may be further compressed to fit the arbor or drive shaft and the nuts tightened again to take up any looseness. It will also be appreciated that the assembly may be lengthened in axial dimension simply by loosening the nuts.

Figure 6:
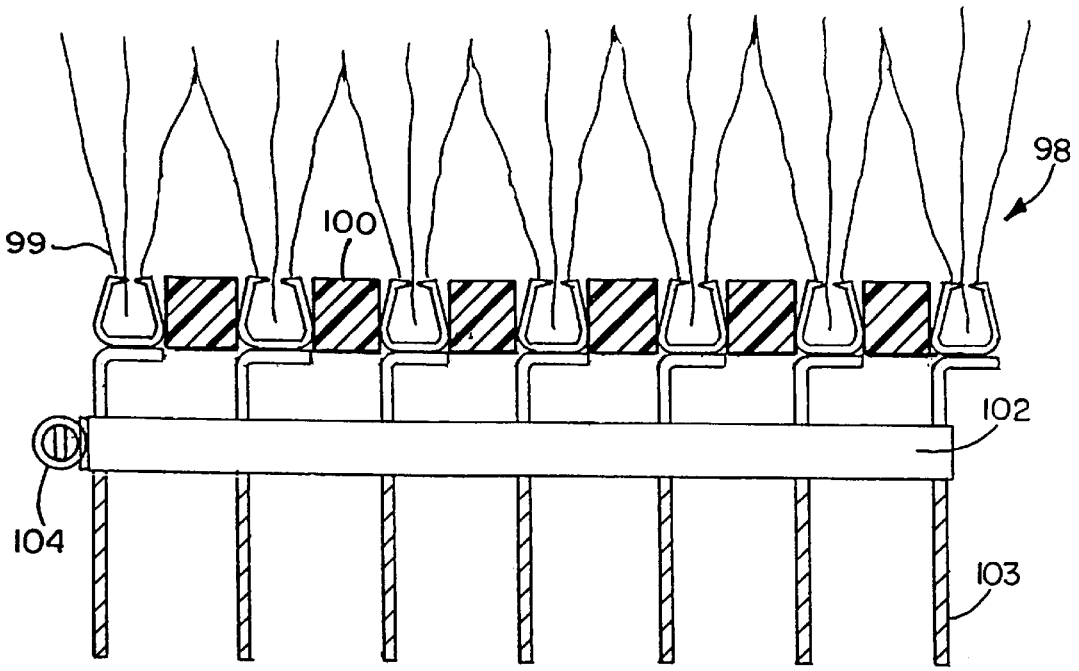
FIG. 6 is a view like FIGS. 4 and 5 but showing plain compressible spacers between each wheel.

Referring now to FIG. 6 there is illustrated yet another embodiment of the invention where the assembly shown generally at 98 comprises buffing wheel sections 99 which have interposed therebetween as spacers plain annular rings 100 rather than worn buffing wheels as seen in FIGS. 4 and 5. The annular rings 100 may vary in both radial and axial dimension. Those illustrated are of the approximate axial dimension of a worn buffing wheel. More importantly, the material of the spacer may vary to accommodate compression, or more specifically partial compression. The material of the spacers may for example be plastic, soft wood, or various rubbers or elastomers which will yield when the stack is aligned and compressed. To hold the assembly 98 in it's partially compressed condition a tie shown generally at 102 is looped around the paired peripheral holes in the core plates 103 and tightened with a pneumatic tool rotating the screw or helix 104. The assembly will thus be unitized when shipped to a customer to a specified face width but in the field during assembly on a machine the axial face width may be compressed further or shortened, or in some cases lengthened.

Figure 7:
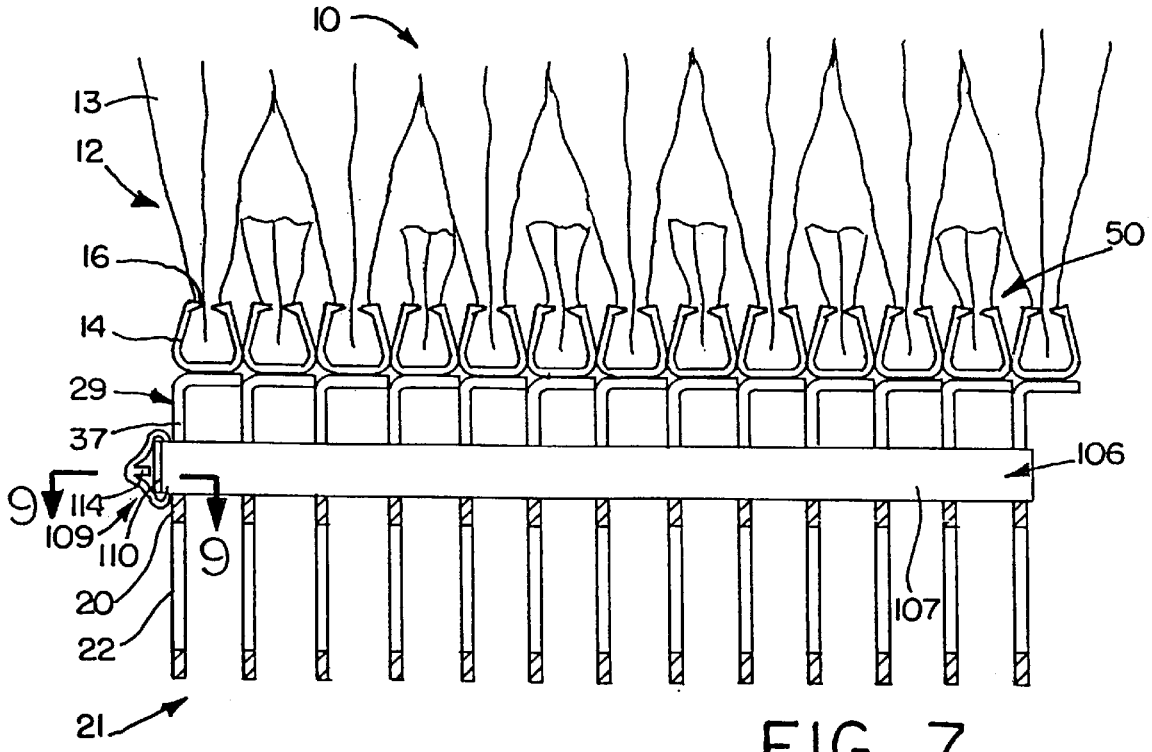
FIG. 7 is a view like FIG. 4 but utilizing another preferred form of tie.
Figure 8:
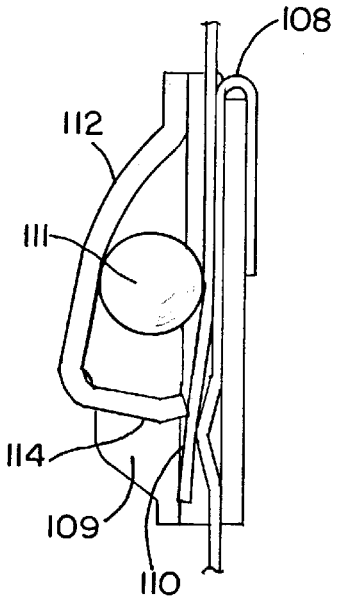
FIG. 8 is a section through the tie as seen from the line 8—8 of FIG. 7.

Another preferred form of a locking tie is the self-locking tie such as shown in FIGS. 7 and 8. This type of stainless steel locking tie uses a self-locking stainless steel wedge ball which allows the free end of the tie to be inserted by hand and tightened by a pistol type hand tool to an adjusted tension. The tool automatically snips off any excess length of the free end.

As seen in FIGS. 7 and 8 the tie is shown generally at 106 and comprises a stainless steel band 107, one end 108 of which is (FIG. 8) folded back and secured to sheet metal housing 109. The other or free end 110 is inserted over the end 108 and through the housing 109 beneath stainless steel ball 111. The wedge shape of the housing indicated at 112 causes the ball to wedge between the housing and the free end 110 locking the free end against retreat. The ball is held in the housing by tang 114.

As indicated the free end 110 may be threaded through the housing by hand and grasped by the tool noted above to be tensioned as determined by the tool adjustment with any excess length of the free end snipped off. A tie such as shown in FIGS. 7 and 8 is sold by Panduit Coporation of Tinley Park, Ill., under the trademark PAN-STEEL.

Figure 9:
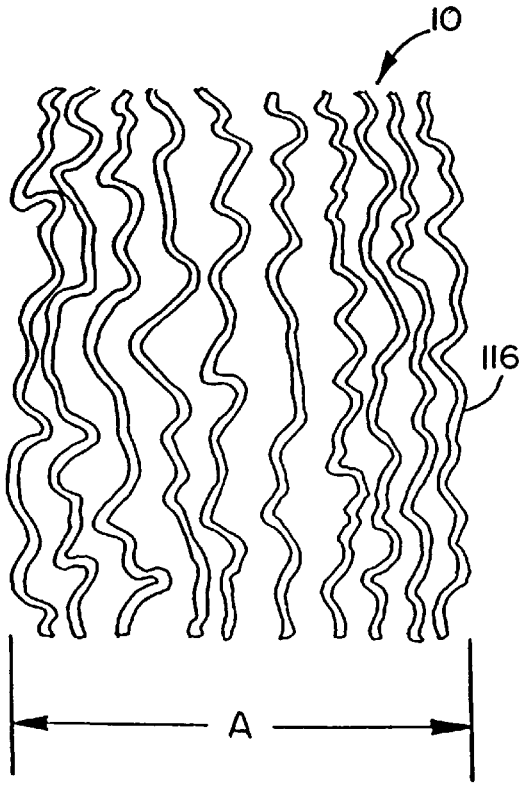
FIG. 9 is view of the buff assembly face before subsequent compression.
Figure 10:
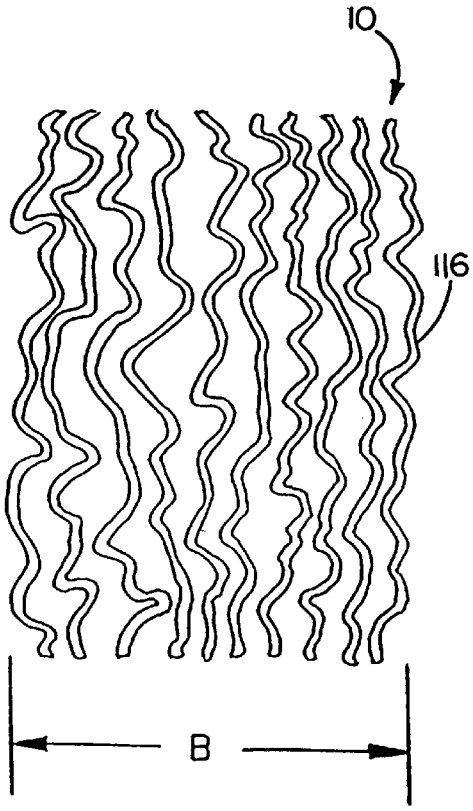
FIG. 10 is a view like FIG. 9 but showing the assembly further compressed.

Referring now to FIGS. 9 and 10 there is illustrated the buffing face of is assembly 10 in accordance with the present invention. The buffing material is shown generally at 116. The buffing material is puckered and folded as illustrated and has been compressed to a face width A. The assembly is held in such unitized form at such face width by the ties or carriage bolts illustrated.

However, when assembled on a machine, the face width can be substantially further compressed to achieve the smaller face width B shown in FIG. 10. In this manner a rigid or unyielding buff or brush assembly of stacked wheels is avoided, making the installation of the assemblies or units on the arbor or drive shaft of a machine much more simple.

It will be appreciated that the axial face width of the assembly, as well as the number of wheels or spacers in the assembly may vary widely.

It can now be seen that there is provided a unitized assembly of buffing or brushing wheel sections with or without spacers between individual wheel sections which is compressed under pressure and held in such unitized condition by cable ties in one embodiment, or screw clamps in another embodiment. In this manner the assembly is yieldable or axially adjustable in face width, and this makes the loading or unloading of the machine shaft a much more simple operation reducing down time as well as other costs to the user.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only be the scope of the claims.

What is claimed is:

1. A method of forming an assembly of buff or brush wheel sections for assembly on the rotatable arbor of a machine comprising the steps of stacking and compressing a plurality of such wheel sections with or without spacers, providing at least the outermost sections or spacers of the stack with core plates, providing such core plates and any intermediate wheel section or spacer core plates with circumferentially spaced and aligned opening sets, tightening a tie looped through said opening sets to hold the assembly together as an integrated bundle of wheel sections, while still permitting axial adjustment of the axial width of the assembly when assembled on the arbor of a machine.

2. A method as set forth in claim 1 including the step of further compressing said assembly, and then further tightening said tie.

3. A method as set forth in claim 1 wherein said tie includes a screw for tightening or loosening said tie, and positioning said screw at an axial end of said assembly to extend generally parallel to the core plate of an outermost section.

4. A method as set forth in claim 1 including the step of providing each opening set with parallel symmetrical edges around which the tie is wrapped.

5. A method as set forth in claim 1 wherein each wheel section includes a clinch ring within which the core plate is secured, and forming said opening sets accommodating said tie at the periphery of each core plate yet clear of the clinch rings.

6. A method as set forth in claim 1 including the step of providing a plurality of ties and opening sets, said ties and opening sets being circumferentially spaced to balance the assembly.

7. A method as set forth in claim 1 wherein each wheel section is a rotary buffing wheel.

8. A preassembled unit of stacked wheel sections for assembly on the arbor of a buffing or brushing machine, said unit comprising a plurality of wheel sections with or without spacers, at least the outermost sections or spacers being provided with core plates, and means extending axially through the core plates to hold the plurality of wheel sections partially compressed so that said preassembled unit may be further compressed axially when mounted on the arbor of the machine, said means extending through the core plates being one or more ties looped through the core plates.

9. A preassembled unit as set forth in claim 8 wherein each tie includes a screw for tightening or loosening the tie.

10. A preassembled unit as set forth in claim 8 wherein each wheel section is a rotary buff, with the buffing material being held by a clinch ring in which the core plate is secured.

11. A preassembled unit as set forth in claim 8, wherein said tie is threaded through a wedge shape housing, and a wedge in said housing locking the tie at an adjusted tension.

12. A preassembled unit as set forth in claim 11, wherein said wedge is a ball.

13. A rotary buff comprising a series of stacked compressed buff wheels with or without spacers, said wheels or spacers including core plates in at least the outermost of said wheels or spacers, and means extending axially through said core plates holding said series in axial compression while permitting further axial compression or expansion when said series is assembled on the arbor of a buffing machine, said means extending axially through the core plates being ties looped through circumferentially spaced holes in the core plates.

14. A rotary buff as set forth in claim 13 wherein each said tie is adjustable as to loop size.

15. A rotary buff as set forth in claim 14 wherein the loop size of each tie is adjusted by a screw.

16. A rotary buff as set forth in claim 14, wherein each tie is threaded through a wedge shape housing, and a wedge in said housing locking said tie at an adjustable tension.

17. A rotary buff as set forth in claim 16 wherein said wedge is a ball.

18. A rotary buff for assembly mounting on the arbor of a machine comprising a series of axially aligned and compressed buff wheels with or without spacers, at least the outer of said series including core plates, and means extending through the core plates of the series to hold the series axially compressed yet enabling further axial compression or axial expansion when mounted on the arbor of the machine, and wherein said means extending through the core plates comprises a plurality of adjustable ties.

* * * * *